US005754091A

United States Patent [19]

Cheong

[11] Patent Number: 5,754,091

[45] Date of Patent: May 19, 1998

[54] POTENTIOMETER-TYPE STEERING SENSOR

[75] Inventor: Yeon-Koo Cheong, Seoul, Rep. of Korea

[73] Assignee: KIA Motors Corporation, Seoul, Rep. of Korea

[21] Appl. No.: 686,628

[22] Filed: Jul. 24, 1996

[30] Foreign Application Priority Data

Apr. 9, 1996 [KR] Rep. of Korea ..... 1996-10654

[51] Int. Cl.[6] ..... H01C 10/32

[52] U.S. Cl. ..... 338/162

[58] Field of Search ..... 338/13, 50, 160, 338/162, 166; 280/263, 267, 270, 442, 446–449

[56] References Cited

U.S. PATENT DOCUMENTS 4,839,579 6/1989 Ito et al. ..... 340/870.43

4,892,329 1/1990 Kozaki et al. ..... 280/772

4,901,050 2/1990 Kotaki et al. ..... 338/13

5,508,921 4/1996 Chikuma et al. ..... 364/424.05

*Primary Examiner*—Matthew V. Nguyen

[57] ABSTRACT

A potentiometer-type steering sensor includes a sensor main body fixed on the steering shaft, comprising a resistor coated concentrically around a center of the body and spirally formed in three-turns, a conducting wire coated parallel to the resistor at a predetermined space on the upper surface of the sensor main body, and at leat two terminals respectively connected to each end of the resistor and the conducting wire; a conductive sliding member which is slidable while contacting the resistor and the conducting wire; a first guide plate, which is fixed on the steering shaft and is provided with a guide slot on which the conductive sliding member is mounted to be slidable in a radial direction; and a second guide plate, which is fixed on the sensor main body and is provided with a guide groove which has the same pattern as that of the resistor to guide the movement of the conductive sliding member.

4 Claims, 5 Drawing Sheets

POTENTIOMETER-TYPE STEERING SENSOR

BACKGROUND

The present invention relates to a sensor for measuring a steering angle of wheels and, more particularly, to a potentiometer-type steering sensor which is mounted on a steering shaft and can measure an absolute value of a steering angle by using characteristics of variable resistance.

Generally, in a four-wheel steering system for a vehicle, there is provided a steering sensor for measuring a steering angle of front wheels, a vehicle speed sensor for measuring vehicle speed, and a rear wheel steering angle sensor for measuring a steering angle of rear wheels. The front and rear wheels are controlled in a same-phase in a low speed range and in a counter-phase in a high speed range in response to signals from the sensors.

Particularly, the front wheel steering sensor is a very important element in the four-wheel steering system.

However, since a steering ratio of the wheels to the steering shaft is about 17.5:1, the steering shaft rotates about ±540° to change the steer direction of the front wheels by about ±35°.

In recent years, an encoder-type steering sensor has been used for measuring the steering angle of the front wheels. However, since the encoder-type steering sensor monitors only the variation state of the steering angle of the front wheels, the number of rotations of the steering shaft cannot be exactly monitored. Therefore, considerable calculation is required for obtaining the absolute value of the rotation of the steering shaft.

In addition, many potentiometer-type steering sensors have also been proposed. However, since these sensors are designed to be mounted on an actuator near the front wheels, a problem of interference with other parts occurs.

SUMMARY

It is an object of the present invention to provide a front wheel steering angle sensor which can be easily mounted without interference with other parts.

It is another object of the present invention to provide a steering sensor which can easily and accurately obtain the rotation value of the steering shaft.

To achieve the above objection, the present invention provides a potentiometer-type steering sensor comprising:

- a steering shaft which rotates in response to a rotation of a steering wheel;
- a sensor main body fixed on the steering shaft, comprising a resistor coated concentrically around a center of the body and spirally formed in three-turns, a conducting wire coated parallel to the resistor at a predetermined space on the upper surface of the sensor main body, and at least two terminals respectively connected to each end of the resistor and the conducting wire;
- a conductive sliding member which is slidable while contacting the resistor and the conducting wire;
- a first guide plate, which is fixed on the steering shaft and is provided with a guide slot on which the conductive sliding member is mounted to be slidable in a radial direction; and
- a second guide plate, which is fixed on the sensor main body and is provided with a guide groove which has the same pattern as that of the resistor to guide the movement of the conductive sliding member.

According to a feature of the present invention, the sensor main body and the second guide plate are provided with a plurality of screw coupling holes so that the sensor main body and the second guide plate can be screw-coupled.

According to another feature of the present invention, more than one fixing bracket, which can be fixed on the steering column, is provided on the sensor main body.

According to still another feature of the present invention, more than one fixing bracket, which can be fixed on the steering column, is provided on the second guide plate.

BRIEF DESCRIPTION OF THE DRAWINGS

The above object, and other features and advantages of the present invention will become more apparent by describing in detail preferred embodiments thereof with reference to the attached drawings, in which.

DETAILED DESCRIPTION OF THE INVENTION

A preferred embodiment of the present invention will now be described in detail with reference to the accompanying drawings.

Figure 1:
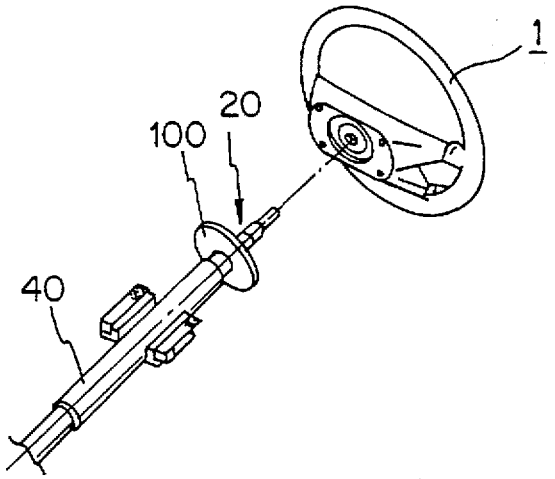
FIG. 1 is an exploded perspective view illustrating a steering shaft where in a potentiometer-type steering sensor according to a preferred embodiment of the present invention is mounted.

Referring first FIG. 1, a potentiometer-type steering sensor 100 is located on a steering shaft 20. The steering shaft 20, which is housed by a steering column 40, rotates by the operation of a steering wheel 1. Although, in the drawing, the steering sensor 100 is mounted on the upper side of the steering shaft 20, it may be mounted anywhere on the steering shaft. However, to avoid separately manufacturing the steering shaft 20, it is preferable to mount the steering sensor 100 on a special location of the steering shaft 20. This will be described more in detail with reference to FIG. 3B.

Figure 2:
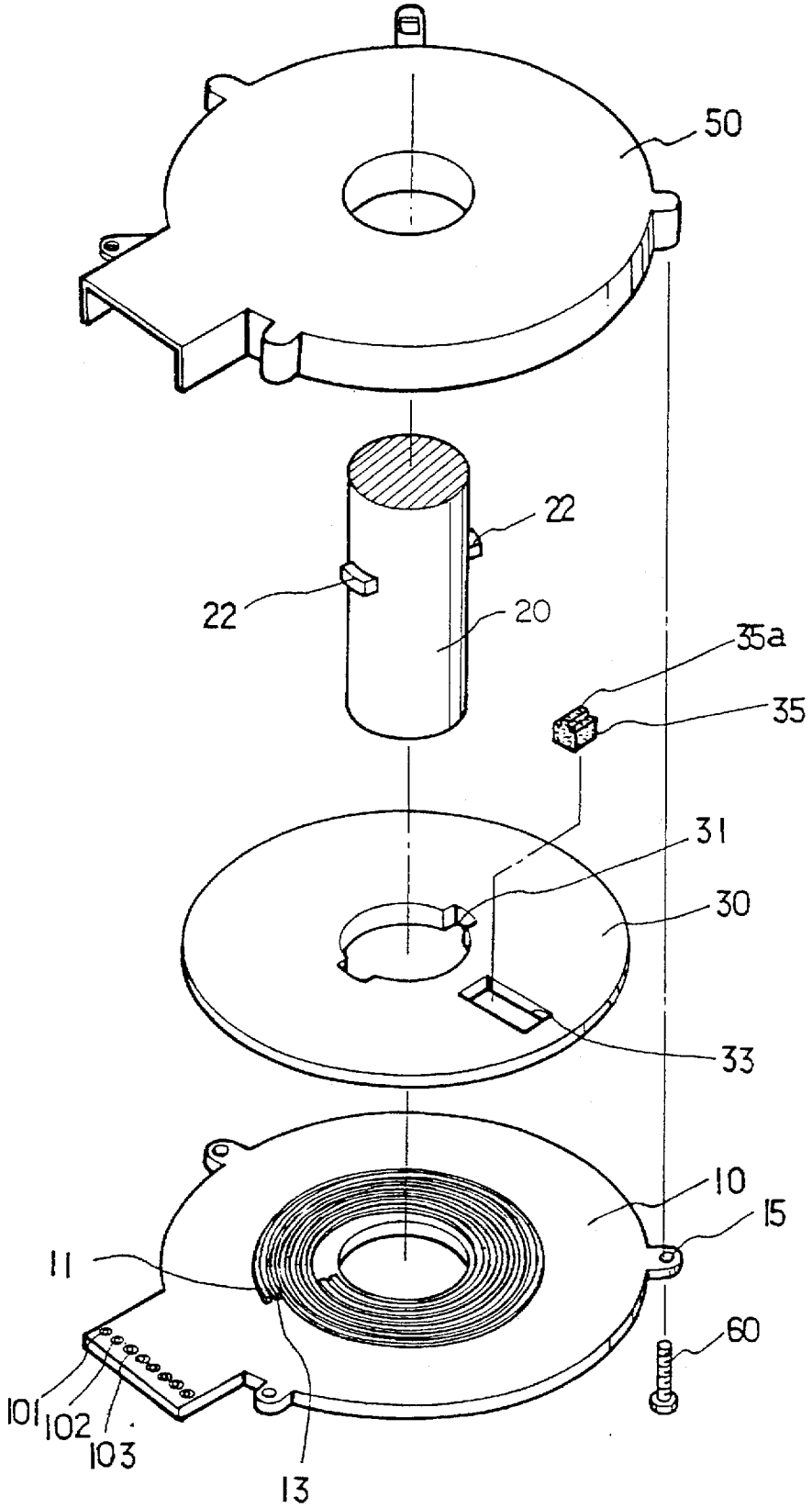
FIG. 2 is an exploded perspective view of a steering sensor in accordance with a preferred embodiment of the present invention.

FIG. 2 is a perspective view of the steering sensor 100 depicted in FIG. 1. There is provided a sensor main body 10. A first guide plate 30 is placed on the sensor main body 10 and a cover plate or second guide plate 50 is placed on the first guide plate 30.

The first guide plate 30 is fixed on the steering shaft 20 to rotate in accordance with the rotation of the steering shaft 20.

Both the sensor main body 10 and the second guide plate 50 are coupled with each other by a plurality of screws 60 and fixed on the steering column 40, thereby not being affected by the rotation of the first guide plate 30.

Figure 3A:
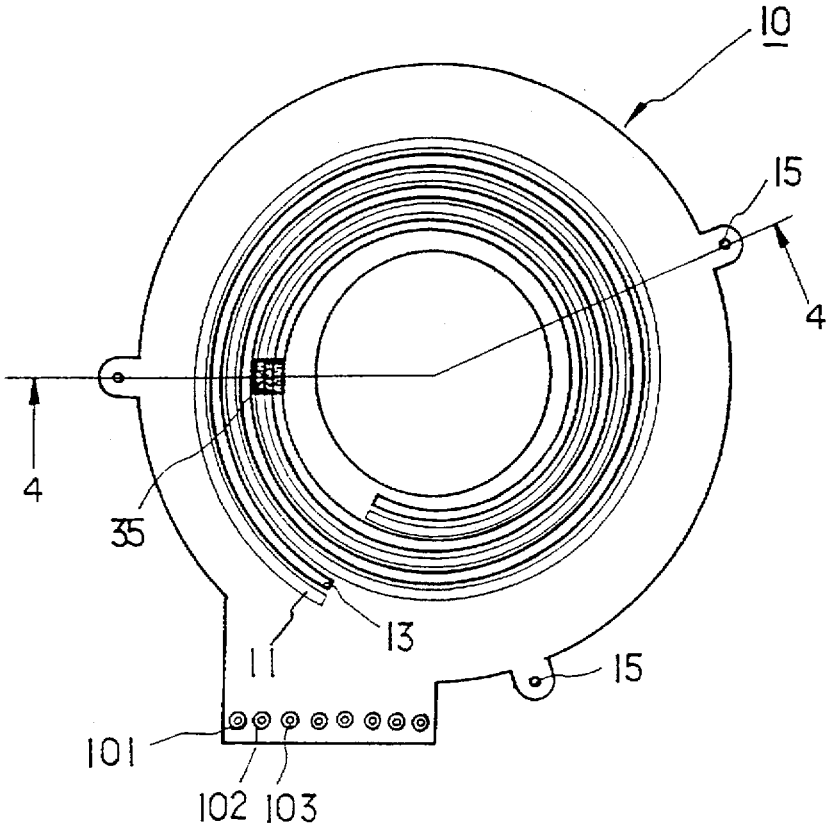
FIG. 3A is an enlarged view illustrating a sensor main body of a steering sensor in accordance with a preferred embodiment of the present invention.
Figure 3B:
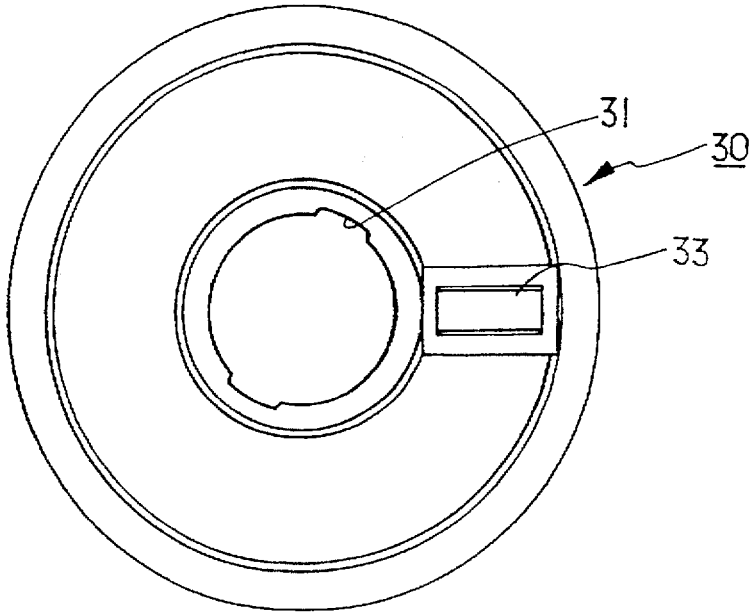
FIG. 3B is an enlarged view illustrating a first guide plate of a steering sensor in accordance with a preferred embodiment of the present invention.
Figure 3C:
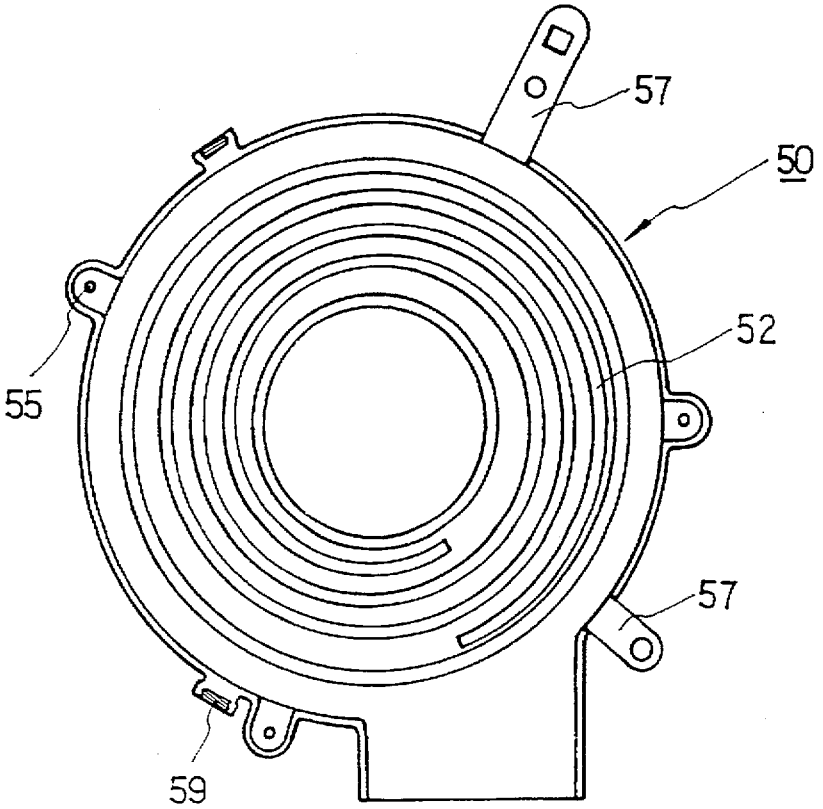
FIG. 3C is an enlarged view illustrating a second guide plate of a steering sensor in accordance with a preferred embodiment of the present invention.

FIGS. 3A, 3B and 3C are enlarged views showing each element of the steering sensor 100. Referring to FIG. 3A showing the sensor main body 10, the sensor main body 10 is of a substantial disk shape. The sensor main body 10 is provided on its upper surface with a spiral-shaped resistor 11 coated concentrically with the central axis of the steering shaft 20. The resistor 11 makes more than three turns. A conducting wire 13 is also coated on the upper surface of the sensor main body 10 such that it is parallel to the resistor 11 at a predetermined space.

In addition, a plurality of screw coupling holes 15 is formed on the edge of the sensor main body 10 so that it can be screw-coupled with the second guide plate 50. The sensor main body 10 is provided with at least three terminals 101, 102 and 103 on its one side.

One of the three terminals 101, 102 and 103, for example the first terminal 101, is electrically connected to an outer end of the resistor 11, another one, for example the second terminal 102, is electrically connected to an outer end of the conducting wire 13.

In addition, the third terminal 103 is electrically connected to an inner end of the resistor 11.

Here, the first and second terminals 101 and 102 are respectively a positive(+) terminal and a negative(−) terminal, and the third terminal is a positive(+) terminal. Although three terminals are sufficient in this embodiment, additional terminals may be provided for other purposes.

The first and third terminals 101 and 103 are applied with a measure reference voltage of about 5V, and the second terminal 102 is connected to a voltmeter(not shown), which can measure a voltage applied between the first and second terminals 101 and 102, such that the voltage applied on the resistor between them can be measured.

FIG. 3B shows the first guide plate 30, in which a fixing notches 31 are formed on a central portion of the first guide plate 30 and a slot 33 is formed such that its longitudinal length is equal to the diameter of the three-turn pattern of the resistor 11 and the conducting wire 13. The slot 33 allows a movement of a conductive sliding member 35.

The fixing notches 31 are fitted on a protrusion(see reference numeral 22 in FIG. 2) formed on the steering shaft 20. The protrusion 22 may be used for mounting an air bag(not shown).

Referring to FIG. 3C showing a second guide plate 50, a guide groove 52 corresponding to the patterns of the resistor 11 and the conducting wire 13 is formed on the lower surface of the second guide plate 50. In the guide groove 52 is fitted an upper projection **35*a* of the conductive sliding member 35, whereby the conductive sliding member 35 slides along the guide groove 52**.

The second guide plate 50 is also provided on its edge with a plurality of screw coupling holes 55 corresponding to the screw coupling holes 15. At least one bracket 57 is also formed on the edge of the second guide plate 50 to mount the second guide plate 50 on the steering column 40.

In addition, the second guide plate 50 is provided with a plurality of tentative fixing members 59 which tentatively fix the first guide plate 30, the sensor main body 10 and the second guide plate 50 to provide an easy screw coupling of the sensor main body 10 with the second guide plate 50. The tentative fixing members 59 have some plastic-elasticity characteristics.

The operation of the steering sensor 100 as described above will be described hereinafter with reference to FIG. 4. The steering shaft 20 rotates in response to the rotation of the steering wheel(not shown) and thereby the first guide plate 30 fixed on the steering shaft 20 rotates.

Figure 4:
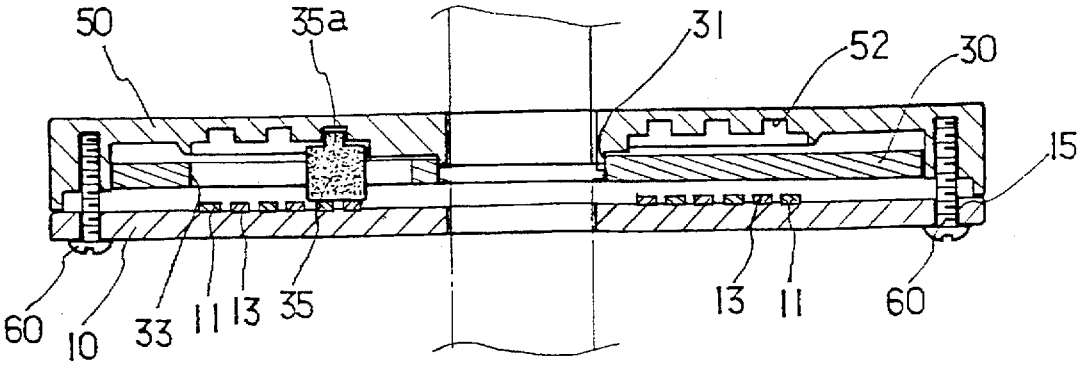
FIG. 4 is a sectional view of a steering sensor in accordance with a preferred embodiment of the present invention.

As the first guide plate 30 rotates, the conductive sliding member 35 is movable radially on the guide slot 33 while its upper protrusion **35*a* slides circumferentially along the guide groove 52 of the second guide plate 50(see FIGS. 3 and 4**).

Accordingly, as shown in FIG. 3A, the conductive sliding member 35 rotates along the pattern of the resistor 11 and the conducting wire 13 such that the length of the resistor 11 between the second terminal 102 connected to the conducting wire 13 and the first terminal 101 varies.

The length variation of the resistor 11 between the second and first terminals 102 and 101 indicates that the voltage level between the second and first terminals 102 and 101 varies. Accordingly, when measuring voltage applied to the second and first terminals 102 and 101, the length of the resistor 11 between the terminals 102 and 101, that is, where the conductive sliding member 35 is located can be identified.

Figure 5:
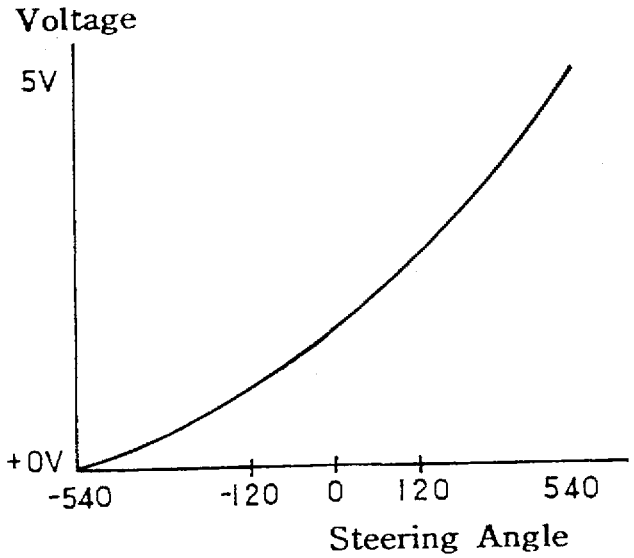
FIG. 5 is a graphical illustration showing an output voltage level of a steering sensor with respect to a steering angle.

FIG. 5 is a graphical illustration of sensor characteristics curve showing voltage levels measured in accordance with steering angle.

It shows that a steering angle range from −540° to +540° can be measured with respect to a voltage change of 5V. linear-analogy of the nonlinear characteristics of the spiral as shown in the graph can be achieved by a software stored in a micro computer.

While the present invention has been particularly shown and described with reference to the particular embodiments thereof, it will be understood by those skilled in the art that various changes in form and details may be effected therein without departing from the spirit and scope of the invention as defined by the appended claims.

What is claimed is:

1. A potentiometer-type steering sensor a sensor main body fixed on a steering shaft, comprising a resistor coated concentrically around a center of the body and spirally formed in three-turns, a conducting wire coated parallel to the resistor at a predetermined space on the upper surface of the sensor main body, and at leat two terminals respectively connected to each end of the resistor and the conducting wire;

a conductive sliding member which is slidable while contacting the resistor and the conducting wire;

a first guide plate fixed on the steering shaft and provided with a guide slot on which the conductive sliding member is mounted to be slidable in a radial direction; and a second guide plate, fixed on the sensor main body and provided with a guide groove which has the same pattern as that of the resistor to guide the movement of the conductive sliding member.

2. A potentiometer-type steering sensor according to claim 1, wherein the sensor main body and the second guide plate are provided with a plurality of screw coupling holes so that the sensor main body and the second guide plate can be screw-coupled.

3. A potentiometer-type steering sensor according to claim 1, wherein more than one fixing bracket, which can be fixed on a steering column, is provided on the sensor main body.

4. A potentiometer-type steering sensor according to claim 1, wherein more than one fixing bracket, which can be fixed on the steering column, is provided on the second guide plate.

* * * * *